US007077788B2

(12) United States Patent
Chang

(10) Patent No.: US 7,077,788 B2
(45) Date of Patent: Jul. 18, 2006

(54) CUSHION DEVICE FOR TREADMILLS

(76) Inventor: Huang-Tung Chang, P.O. Box 487, Chang-Hua City 500 (TW)

( * ) Notice: Subject to any disclaimer, the term of this patent is extended or adjusted under 35 U.S.C. 154(b) by 0 days.

(21) Appl. No.: 11/118,428

(22) Filed: May 2, 2005

(65) Prior Publication Data

US 2005/0250622 A1 Nov. 10, 2005

(30) Foreign Application Priority Data

May 5, 2004 (TW) ..... 93206953 U

(51) Int. Cl.
*A63B 22/00* (2006.01)

(52) U.S. Cl. ..... 482/54; 482/51

(58) Field of Classification Search ..... 482/51, 482/54; 119/700

See application file for complete search history.

(56) References Cited

U.S. PATENT DOCUMENTS 5,827,155 A * 10/1998 Jensen et al. ..... 482/54
6,280,362 B1 * 8/2001 Dalebout et al. ..... 482/54
6,325,746 B1 * 12/2001 Wang et al. ..... 482/54

* cited by examiner

*Primary Examiner*—Glenn Richman
*Assistant Examiner*—Greg Huson

(57) ABSTRACT

A cushion device for treadmills includes a frame with two rails and a deck has an end pivotably connected to two respective first ends of the two rails of the frame. Two tubes are connected to the two rails of the frame and two activation rods axially extend in the two tubes and are restrained to only can spin relative to the tubes. Each of the two activation rods has a nut member threadedly connected thereto and a slide member is slidably mounted thereto. A spring is mounted to each of the two activation rods and biased between the nut member and the slide member. Two cables have two respective first ends fixed to the slide members and two respectively second ends of the two cables extend through each tube, reeve through the lower pulley and the upper pulley and are fixed to the first end of the deck.

15 Claims, 8 Drawing Sheets

CUSHION DEVICE FOR TREADMILLS

FIELD OF THE INVENTION

The present invention relates to a cushion device for providing flexibility of cushion function to the users when using the treadmills.

BACKGROUND OF THE INVENTION

A conventional cushion device for treadmills is disclosed in U.S. Pat. No. 5,827,155 and includes a leaf spring connected between the side rails of the frame. The free ends of the leaf spring are connected to downward feet. The is a proper height between the leaf spring and the frame so that when the users are jogging one the endless belt of the treadmill, the deck for supporting the users is flexible and of the treadmill. An adjustable device includes a lever and a rack which is engaged with an adjustable toothed member so that when operating the lever, the distance between the rear part of the leaf spring and the frame can be adjusted so that the spring or cushion force can be adjusted.

However, the rear part of the frame is supported by one piece of leaf spring so that the frame shakes at a frequency which might not be the same as the frequency as the users jogging on the endless belt. In other words, the moving deck together with the endless belt confuses the user where the exact position of the endless belt is and this might cause ankle injury of the users. Besides, the length of the leaf spring has to be limited. If the leaf spring is too long and in contact with the frame, there will be no flexibility. If the leaf spring is too short, the flexibility is limited in a narrow range which is not satisfied by the users.

The present invention intends to provide a cushion device for treadmills wherein the deck is supported by two sets of cushion assemblies which absorb the shakes and vibration.

SUMMARY OF THE INVENTION

The present invention relates to a cushion device for treadmills, wherein the treadmill comprises a frame having two longitudinal rails and two upper pulleys and two lower pulleys are respectively connected to two respective insides of first ends of the two rails of the frame. A deck has two pairs of holes defined through two sides of a first end of the deck and a second end of the deck is pivotably connected to two respective second ends of the two rails of the frame.

Two tubes are connected to the two rails of the frame and two activation rods axially extend in the two tubes. Each of the two activation rods has a nut member threadedly connected to a threaded section thereof and two slide members are slidably mounted to the two activation rods, two springs are mounted to the two activation rods and biased between the nut member and the slide member. Two bars radially extend through each of the two tubes and each activation rod in each tube includes a groove defined in a plain section thereof so that the activation rod spins in the tube.

Two cables have two respective first ends fixed to the slide members and two respectively second ends extend through each tube, reeve through the lower pulley and the upper pulley and are fixed to the first end of the deck.

The primary object of the present invention is to provide a cushion device for treadmills wherein the deck is supported on two sides thereof and the cushion device can be adjusted.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENTS

Figure 1:
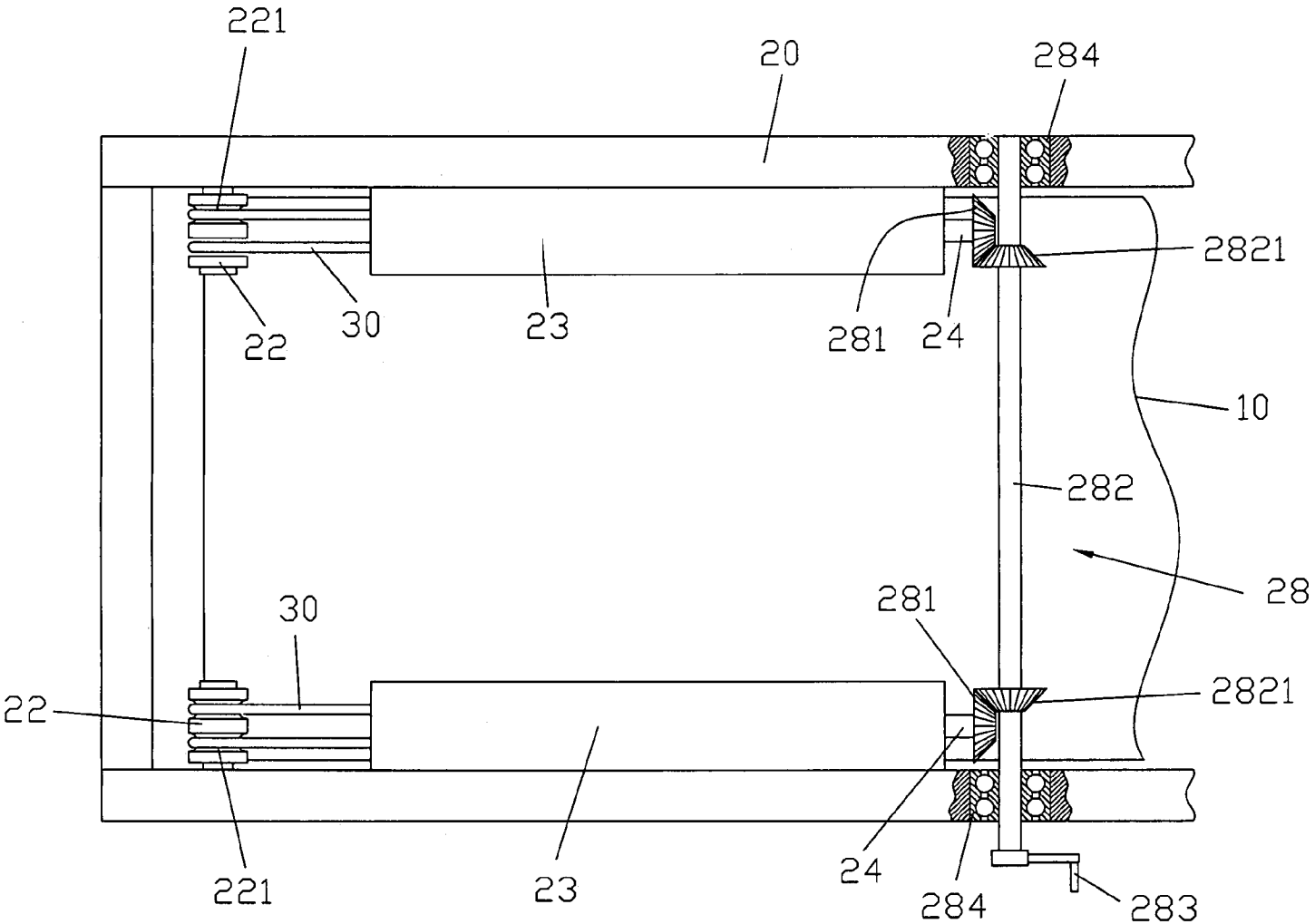
FIG. 1 is a top view to show the cushion device of the present invention.
Figure 2:
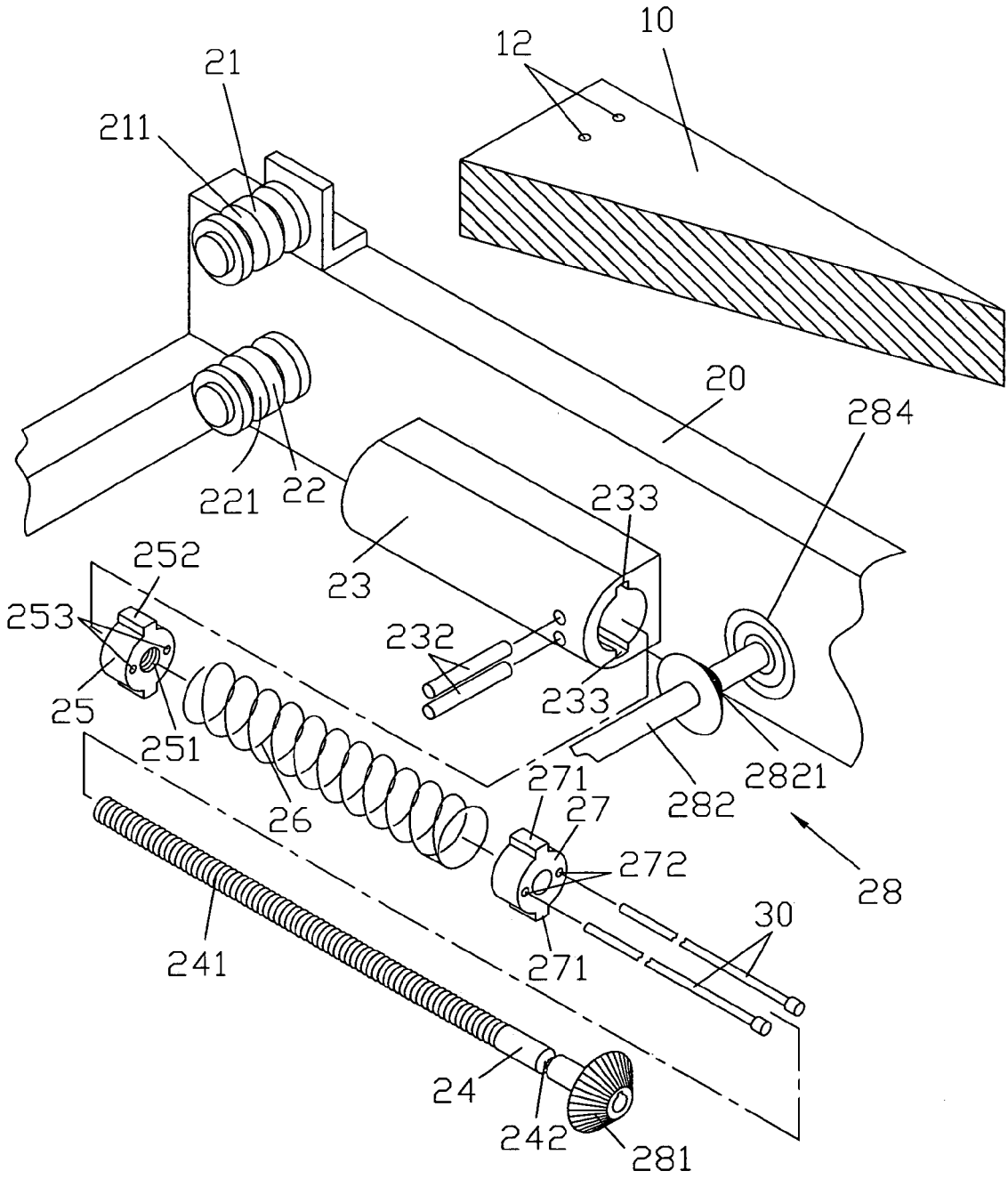
FIG. 2 is an exploded view to show the cushion device of the present invention.
Figure 3:
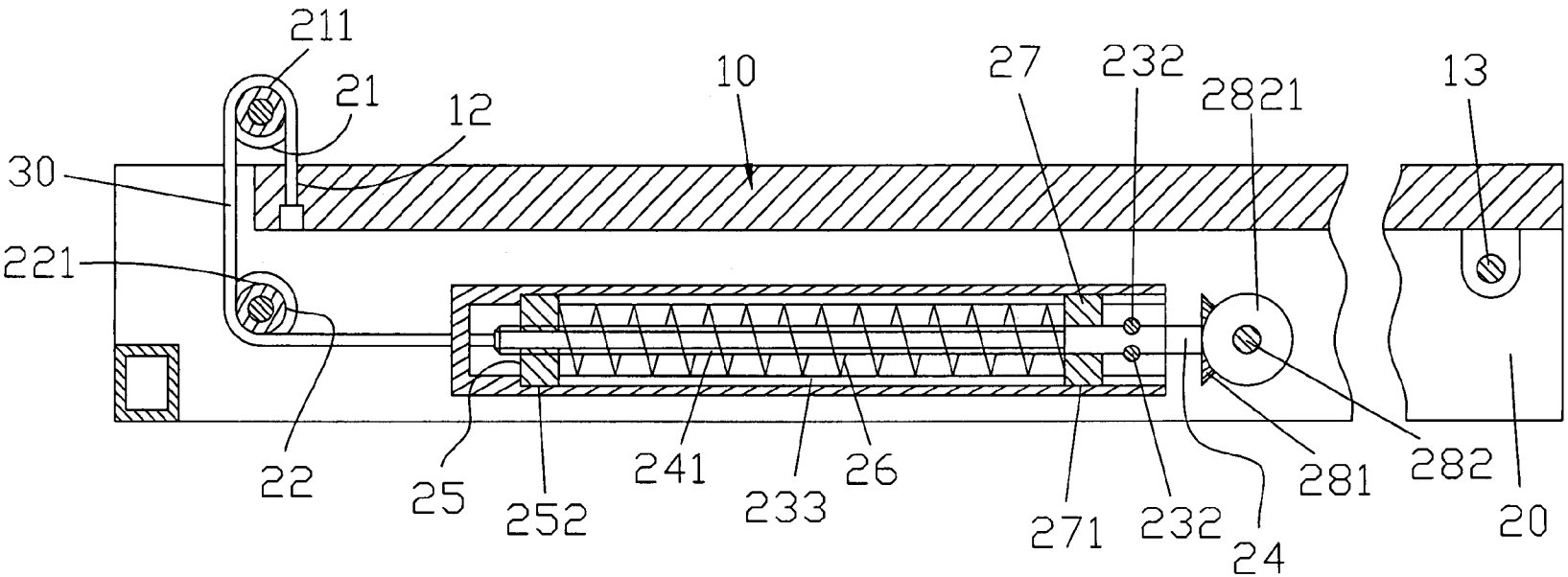
FIG. 3 is a side cross sectional view of the cushion device of the present invention.
Figure 4:
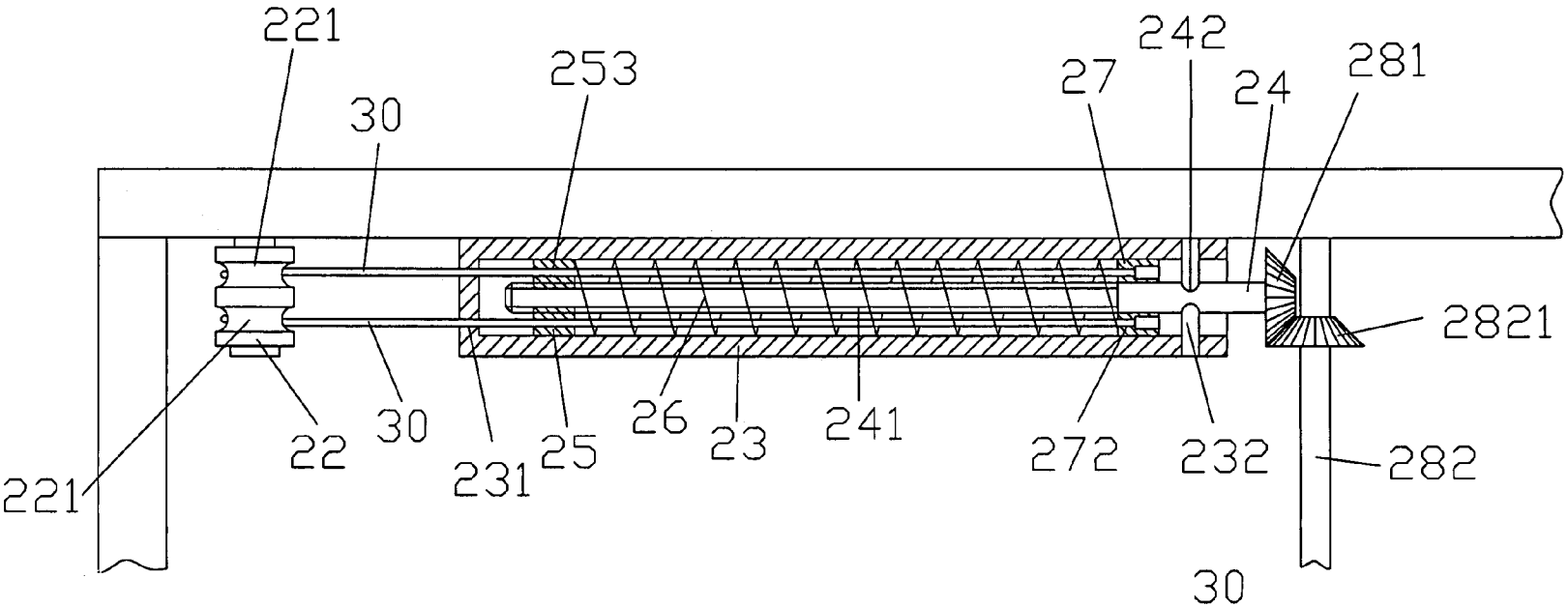
FIG. 4 is a top cross sectional view of the cushion device of the present invention.

Referring to FIGS. 1 to 4, the cushion device for treadmills of the present invention comprises a frame 20 which is a rectangular frame and has two longitudinal rails. Two upper pulleys 21 and two lower pulleys 22 are respectively connected to two respective insides of first ends of the two rails of the frame 20. A deck 10 has two pairs of holes 231 defined through two sides of a first end of the deck 10 and a second end of the deck 10 pivotably connected to two respective second ends of the two rails of the frame 20. An endless belt trained to two rollers (both not shown) are connected to the frame 20 and the deck 10 is located between upper and lower portions of the endless belt so as to support the players jogging on the belt.

Two tubes 23 are connected to the two rails of the frame 20 and two activation rods 24 axially extend in the two tubes 23. Each of the two activation rods 24 has a nut member 25 threadedly connected to a threaded section 241 thereof. Two slide members 27 are slidably mounted to the two activation rods 24. Two springs 26 are mounted to the two activation rods 24 and biased between the nut member 25 and the slide member 27. Each of the two tubes 23 includes two axial grooves 233 defined in an inner periphery thereof and each of the nut members 25 and the slide members 27 has two lugs 252/271 which are movably engaged with the axial grooves 233. Two bars 232 radially extend through each of the two tubes 23 and each activation rod 24 in each tube 23 includes a groove 242 defined in a plain section thereof so that the activation rod 24 spins in the tube 23 and does not moved in the axial direction. Each of the two slide members 27 has two engaging holes 272 with which the two first ends of the two cables 30 are securely engaged. Each of the two nut members 25 has two through holes 253 through which the second ends of the cables 30 extend. Each of the two tubes 23 has a closed end through which two apertures 231 are defined and the second ends of the two cables 30 extend through the two apertures 231. The second ends of the two cables 30 reeve through the lower pulley 22 and the upper pulley 21 and are inserted in the holes 231 of the deck 10 and fixed to the first end of the deck 10. Each of the upper pulleys 21 and the lower pulleys 22 has two annular grooves 211/221 through which the cables 30 reeve. The cables 30 can be metal cables such as steel cables.

An adjustable device 28 is connected to the frame 20 so as to adjust the springs 26 in the two tubes 23. The adjustable device 28 includes a first bevel gear 281 connected to an end of each of the two activation rods 24 and a shaft 282 is connected between the two rails of the frame 20. Two bearings 284 are mounted to the shaft 282 and received in the two rails of the frame 20. Two second bevel gears 2821 are mounted to the shaft 281 and engaged with the first bevel gears 281. A crank handle 283 is connected to an end of the shaft 282 so that by rotating the crank handle 283, the two activation rods 24 spin so as to move the slide members 27 to compress the springs 26. By the adjustment of the springs 26, the cushion function to the deck 10 is adjusted.

Figure 5:
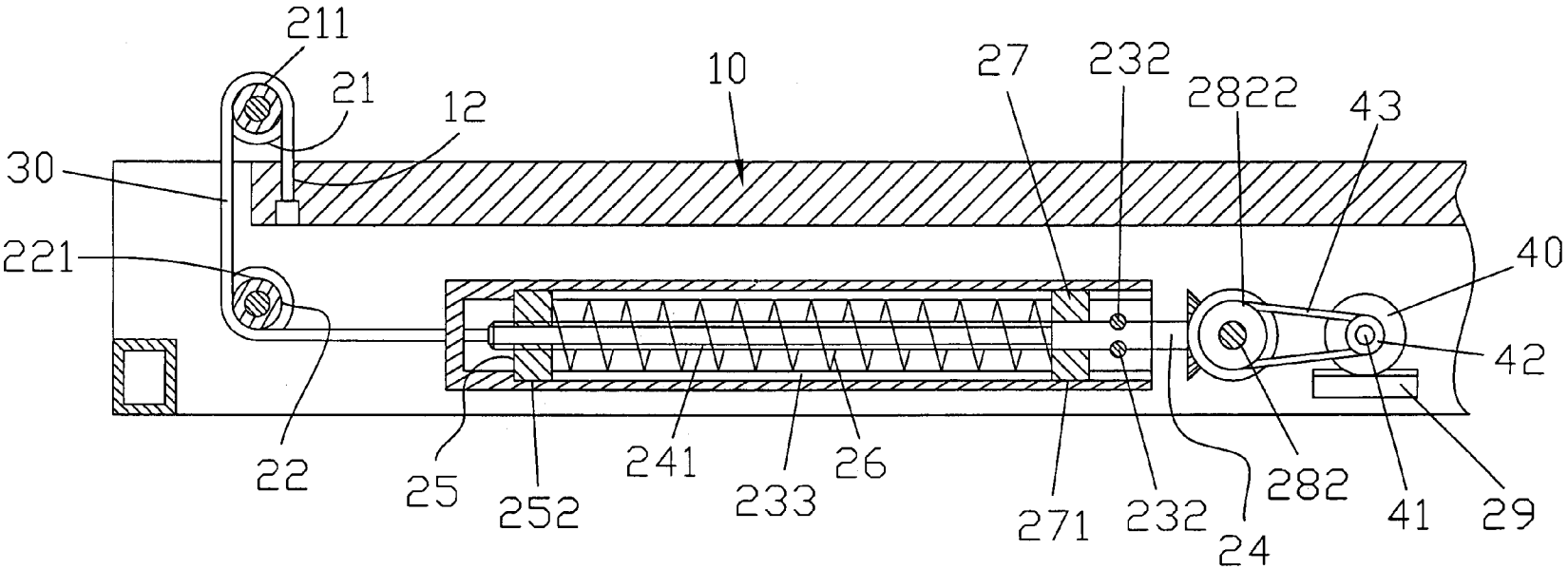
FIG. 5 shows another embodiment of the cushion device of the present invention.

As shown in FIG. 5, the crank handle 283 for rotating the shaft 282 can be replaced by using a motor 40 which is connected to a platform 29 connected to one of the rails of the frame 20. A driving wheel 42 is connected to an output shaft 41 of the motor 40 and a driven wheel 2822 is connected to the shaft 282. A transmission member 43 is trained between the driving wheel 42 and the driven wheel 2822.

Figure 6:
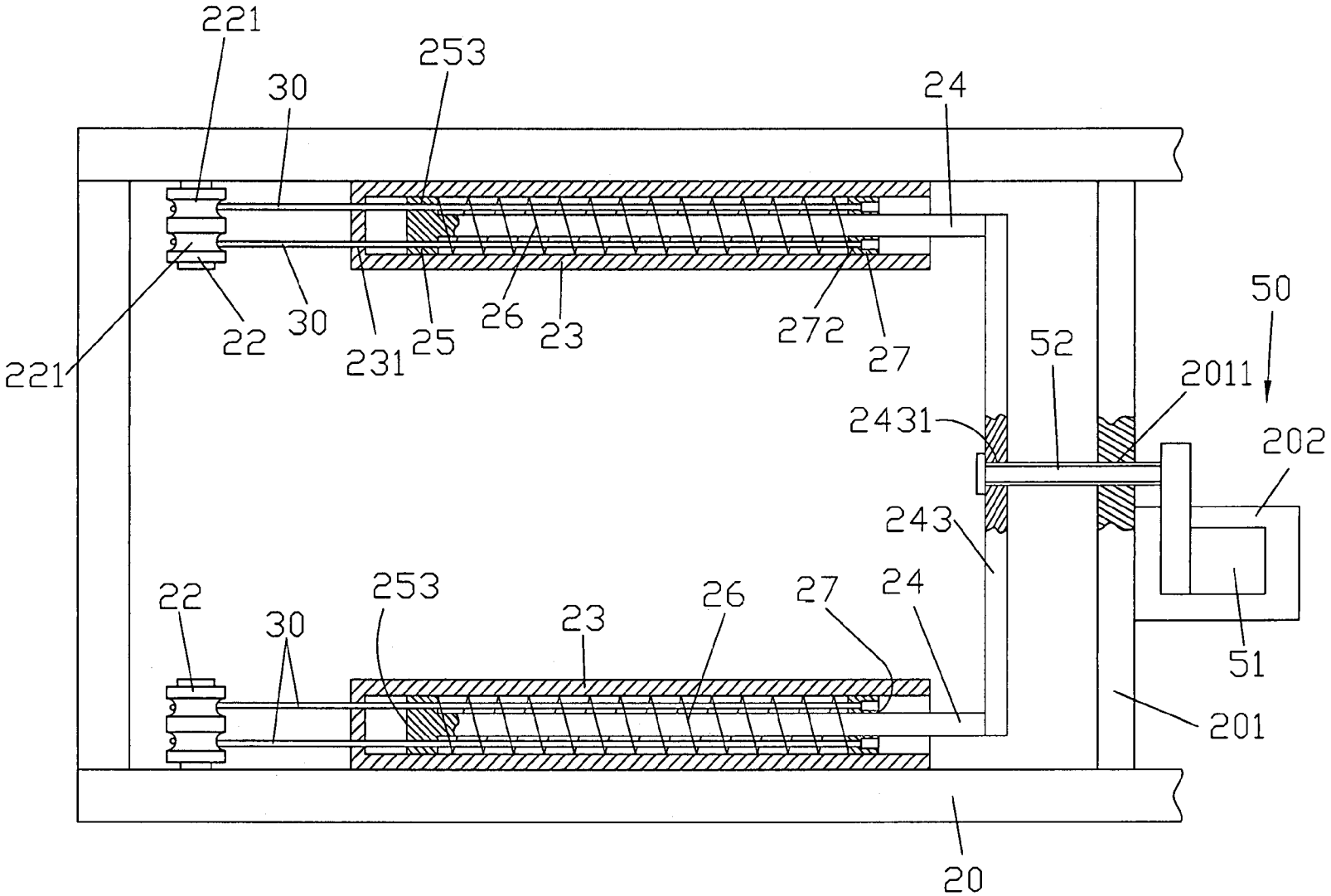
FIG. 6 shows yet another embodiment of the cushion device of the present invention.

As shown in FIG. 6 which shows another embodiment wherein the adjustable device 28 includes a connection rod 243 connected between the two activation rods 24 and a threaded hole 2431 is defined through the connection rod 243. A transverse bar 201 is connected between the two rails of the frame 20 and a through hole 2011 is defined through the transverse bar 201. A threaded bar 52 has one end threadedly engaged with the threaded hole 2431 in the connection rod 243 and a clip is fixed on the first end of the threaded bar 52 so that the threaded bar 52 can only spin relative to the connection rod 243. The other end of the threaded bar 52 extends through the through hole 2011 and is driven by a motor 51 which is rested on a platform 202 connected to the transverse bar 201. The connection rod 243 moves along the threaded bar 52 so as to move the two activation rods 24 when the threaded bar 52 is rotated. By this way, the springs 26 can be adjusted. It is noted that the nut members 25 in FIGS. 1–5 are replaced by fixed end members 253 as shown.

Figure 7:
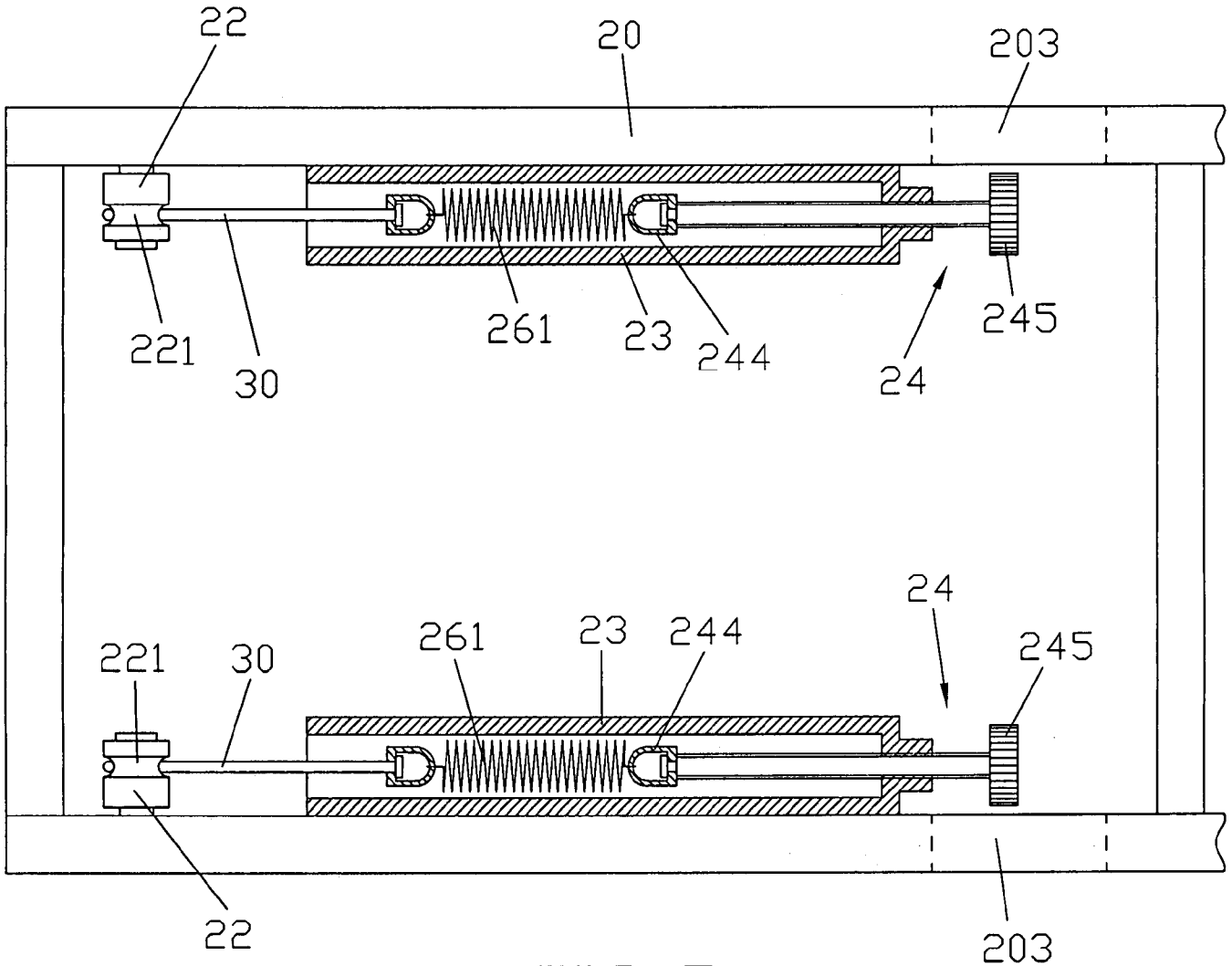
FIG. 7 shows a further embodiment of the cushion device of the present invention.

As shown in FIG. 7 which shows a further embodiment wherein the differences from the previous embodiments are that each of the two threaded activation rods 24 has a rotatable ring 244 connected to an end thereof in the tube 23. Two springs 261 are received in the two tubes 23 and one end of each spring 261 is connected to the respective one of the two rotatable ring 244, the other end of each activation rod 24 has a knob 245. A cable 30 has a first end extending into each of the tubes 23 and is fixed to the other end of the spring 261 in the tube 23. The other end of the cable 30 extends through tube 23, reeves through the lower pulley 22 and the upper pulley 21 and is fixed to the first end of the deck 10. Each of the two rails of the frame 20 has an access hole 203 so as to access the knob 245 on the activation rod 24. By rotating the knobs 245, the threaded activation rods 24 are moved axially in the tubes 23 to compress the springs 261.

Figure 8:
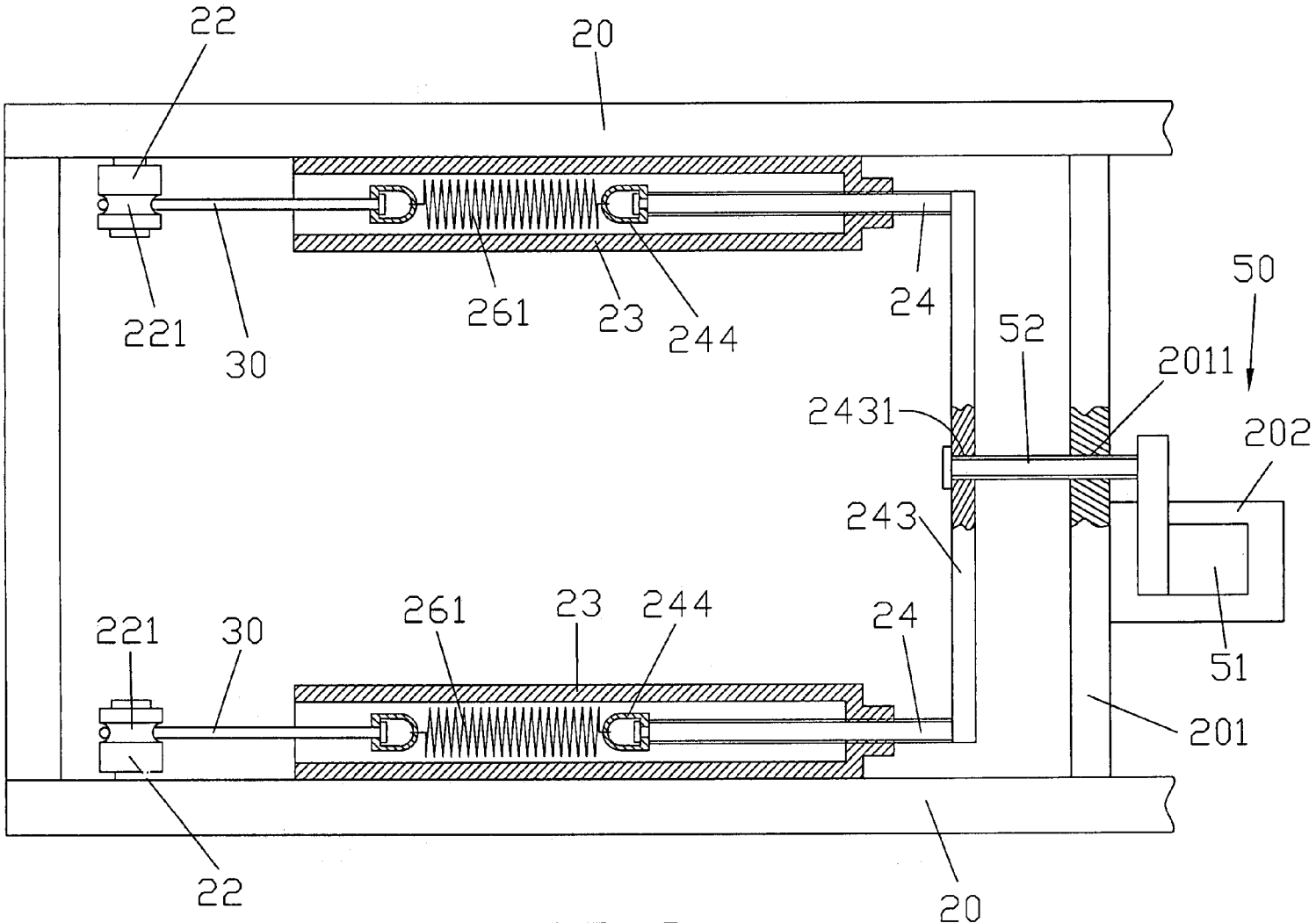
FIG. 8 shows another embodiment of the cushion device of the present invention.

FIG. 8 shows yet another embodiment, wherein each of the two activation rods 24 movably extends through the tube 23 and has a rotatable ring 244 connected to an end thereof in the tube 23. Two springs 261 are received in the two tubes 23 and one end of each spring 26 is connected to the respective one of the two rotatable ring 244. A cable 30 has a first end extending into each of the tubes 23 and is fixed to another ring that is fixed to the other end of the spring 26 in the tube 23. The other end of the cable 30 extends through tube 23, reeves through the lower pulley 22 and the upper pulley 21 and is fixed to the first end of the deck 10. A connection rod 243 is connected between the two activation rods 24 and a threaded hole 2431 is defined through the connection rod 243. A transverse bar 201 is connected between the two rails of the frame 20 and a through hole 2011 is defined through the transverse bar 201. A threaded bar 52 has one end threadedly engaged with the threaded hole 2431 in the connection rod 243 and a clip is fixed on the first end of the threaded bar 52. The other end of the threaded bar 52 extends through the through hole 2011 and is driven by a motor 51 which is rested on a platform 202 connected to the transverse bar 201. The connection rod 243 moves the two activation rods 24 when the threaded bar 52 is rotated.

While we have shown and described the embodiment in accordance with the present invention, it should be clear to those skilled in the art that further embodiments may be made without departing from the scope of the present invention.

What is claimed is:

1. A cushion device for treadmills, comprising:

a frame having two longitudinal rails and two upper pulleys and two lower pulleys respectively connected to two respective insides of first ends of the two rails of the frame;

a deck having two pairs of holes defined through two sides of a first end of the deck and a second end of the deck pivotably connected to two respective second ends of the two rails of the frame;

two tubes are connected to the two rails of the frame and two activation rods axially extending in the two tubes, each of the two activation rods having a nut member threadedly connected to a threaded section thereof, two slide members slidably mounted to the two activation rods, two springs mounted to the two activation rods and biased between the nut member and the slide member, two bars radially extending through each of the two tubes and each activation rod in each tube including a groove defined in a plain section thereof so that the activation rod spins in the tube, and two cables having two respective first ends fixed to the slide members and two respectively second ends extending through each tube, reeving through the lower pulley and the upper pulley and fixed to the first end of the deck.

2. The device as claimed in claim 1, wherein each of the two tubes has a closed end through which two apertures are defined and the two cables extend through the two apertures.

3. The device as claimed in claim 1, wherein each of the two nut members has two through holes through which the cables extend.

4. The device as claimed in claim 1, wherein each of the two slide members has two engaging holes with which the two first ends of the two cables are securely engaged.

5. The device as claimed in claim 1, wherein each of the two tubes includes two axial grooves defined in an inner periphery thereof and each of the nut members and the slide members has two lugs which are movably engaged with the axial grooves.

6. The device as claimed in claim 1, wherein each of the upper pulleys and the lower pulleys has two annular grooves through which the cables reeve.

7. The device as claimed in claim 1, wherein an adjustable device is connected to the frame so as to adjust the springs.

8. The device as claimed in claim 7, wherein the adjustable device includes a first bevel gear connected to an end of each of the two activation rods and a shaft is connected between the two rails of the frame, two second bevel gears are mounted to the shaft and engaged with the first bevel gears, a crank handle is connected to an end of the shaft.

9. The device as claimed in claim 8, wherein bearings are mounted to the shaft and received in the two rails of the frame.

10. The device as claimed in claim 8, wherein a motor is connected to the shaft.

11. The device as claimed in claim 8, wherein a platform is connected to one of the rails of the frame and a motor is fixed on the platform, a driving wheel is connected to an output shaft of the motor, a driven wheel is connected to the shaft, a transmission member trained between the driving wheel and the driven wheel.

12. The device as claimed in claim 7, wherein the adjustable device includes a connection rod connected between the two activation rods and a threaded hole is defined through the connection rod, a transverse bar is connected between the two rails of the frame and a through hole is defined through the transverse bar, a threaded bar has one end threadedly engaged with the threaded hole in the connection rod and a clip is fixed on the first end of the threaded bar, the other end of the threaded bar extends through the through hole and is driven by a motor which is rested on a platform connected to the transverse bar, the connection rod moves the two activation rods when the threaded bar is rotated.

13. A cushion device for treadmills, comprising:

a frame having two longitudinal rails and two upper pulleys and two lower pulleys respectively connected to two respective insides of first ends of the two rails of the frame;

a deck having two pairs of holes defined through two sides of a first end of the deck and a second end of the deck pivotably connected to two respective second ends of the two rails of the frame;

two tubes are connected to the two rails of the frame and two activation rods axially extending in the two tubes, each of the two activation rods having a rotatable ring connected to an end thereof in the tube, two springs received in the two tubes and one end of each spring connected to the respective one of the two rotatable ring, the other end of each activation rod having a knob, and a cable having a first end extending into each of the tubes and fixed to the other end of the spring in the tube, the other end of the cable extending through tube, reeving through the lower pulley and the upper pulley and fixed to the first end of the deck.

14. The device as claimed in claim 13, wherein each of the two rails of the frame has an access hole so as to access the knob on the activation rod.

15. The device as claimed in claim 13, wherein a connection rod is connected between the two activation rods and a threaded hole is defined through the connection rod, a transverse bar is connected between the two rails of the frame and a through hole is defined through the transverse bar, a threaded bar has one end threadedly engaged with the threaded hole in the connection rod and a clip is fixed on the first end of the threaded bar, the other end of the threaded bar extends through the through hole and is driven by a motor which is rested on a platform connected to the transverse bar, the connection rod moves the two activation rods when the threaded bar is rotated.

* * * * *